US008713867B2

(12) United States Patent
Sawada

(10) Patent No.: US 8,713,867 B2
(45) Date of Patent: May 6, 2014

(54) UNIT STRUCTURAL MEMBER FOR BUILDING AND FLOOR STRUCTURE UTILIZING THE UNIT STRUCTURAL MEMBER

(75) Inventor: Taiichi Sawada, Tokyo (JP)

(73) Assignee: CDS Nu Steel Holdings Limited, Hong Kong (HK)

( * ) Notice: Subject to any disclaimer, the term of this patent is extended or adjusted under 35 U.S.C. 154(b) by 0 days.

(21) Appl. No.: 13/203,485

(22) PCT Filed: Feb. 19, 2010

(86) PCT No.: PCT/JP2010/052496

§ 371 (c)(1),
(2), (4) Date: Aug. 26, 2011

(87) PCT Pub. No.: WO2010/098254

PCT Pub. Date: Sep. 2, 2010

(65) Prior Publication Data

US 2011/0302870 A1 Dec. 15, 2011

(30) Foreign Application Priority Data

Feb. 27, 2009 (JP) ..... 2009-046340

(51) Int. Cl.
*E04C 2/52* (2006.01)

(52) U.S. Cl.
USPC ..... 52/220.4; 52/846; 52/842; 52/851; 52/783.19; 52/798.1; 52/783.11

(58) Field of Classification Search
USPC ..... 52/745.13, 844, 843, 579, 481.2, 842, 52/840, 851, 783.19, 220.4, 783.11, 220.1, 52/798.1, 846, 414; 296/184.1
See application file for complete search history.

(56) References Cited

U.S. PATENT DOCUMENTS

| | | | | | |
|---|---|---|---|---|---|
| 2,356,309 | A | * | 8/1944 | Garbe | 52/481.2 |
| 2,508,032 | A | * | 5/1950 | Kennedy | 52/847 |
| 3,278,043 | A | * | 10/1966 | Kimpton | 211/191 |
| 3,611,666 | A | * | 10/1971 | Poyser et al. | 52/844 |
| 3,977,149 | A | * | 8/1976 | Haynes et al. | 52/579 |
| 4,069,638 | A | * | 1/1978 | Hasselqvist et al. | 52/843 |
| 4,125,977 | A | * | 11/1978 | Michlovic | 52/220.4 |

(Continued)

FOREIGN PATENT DOCUMENTS

| | | |
|---|---|---|
| JP | H11-001993 | 1/1999 |
| JP | H11-280203 | 10/1999 |

(Continued)

*Primary Examiner* — Chi Q Nguyen
(74) *Attorney, Agent, or Firm* — Jianq Chyun IP Office

(57) ABSTRACT

A unit structural member 20 for building utilizes an M-shaped channel 1 which includes a center U-shaped channel section 2 and right and left U-shaped channel sections 6, 5 continuously formed to share right and left side plates 4, 3 of the center U-shaped channel section 2. A channel trench 7 of the center U-shaped channel section 2 and respective channel trenches 9, 8 of the right and left U-shaped channel sections 6, 5 are opened in opposite directions. The unit structural member 20 for building is constituted with a pair of longitudinal beams 15 formed of long pieces of material of the M-shaped channel 1 in parallel at an established distance and a number of lateral beams formed of short pieces of material of the M-shaped channel 1 in parallel laterally between the parallely-arranged longitudinal beams 15 at established distances in the longitudinal direction of the longitudinal beams 15.

5 Claims, 12 Drawing Sheets

(56) References Cited

U.S. PATENT DOCUMENTS

| | | | | | |
|---|---|---|---|---|---|
| 4,129,917 | A | * | 12/1978 | Sivachenko et al. | 14/73 |
| 4,192,119 | A | * | 3/1980 | Murphy | 52/844 |
| 4,718,214 | A | * | 1/1988 | Waggoner | 52/783.19 |
| 5,095,678 | A | * | 3/1992 | Murphy | 52/844 |
| 5,632,126 | A | * | 5/1997 | Agsten | 52/426 |
| 6,092,862 | A | * | 7/2000 | Kuwahara | 296/184.1 |
| 6,189,930 | B1 | * | 2/2001 | Kalazny | 280/781 |

FOREIGN PATENT DOCUMENTS

| | | |
|---|---|---|
| JP | 2000-008542 | 1/2000 |
| JP | 2000-017766 | 1/2000 |
| JP | 2000-309992 | 11/2000 |
| JP | 2000-309993 | 11/2000 |
| WO | 0109451 | 2/2001 |

* cited by examiner

UNIT STRUCTURAL MEMBER FOR BUILDING AND FLOOR STRUCTURE UTILIZING THE UNIT STRUCTURAL MEMBER

CROSS-REFERENCE TO RELATED APPLICATION

This application is a 371 of international application of PCT application serial no. PCT/JP2010/052496, filed on Feb. 19, 2010, which claims the priority benefit of Japan application no. 2009-046340, filed on Feb. 27, 2009. The entirety of each of the above-mentioned patent applications is hereby incorporated by reference herein and made a part of this specification.

TECHNICAL FIELD

The present invention relates to a unit structural member for building utilizing an M-shaped channel formed of metal and a floor structure utilizing the unit structural member.

BACKGROUND ART

The applicant has found superiority of metal-made M-shaped channels as load-bearing material for building against other-shape channels (i.e., shaped steel) and has advanced research perennially on steal houses utilizing the M-shaped channels as structural elements. Japanese Patent Application Laid-Open No. 2000-309993, 2000-309992, 2000-017766, 2000-008542, No. 11-280203, No. 11-001993 and Re-publication No. 01/009451 were applications as the results thereof.

A steel house being superior in durability, quake-resistant capability and fire-resistant capability is hopeful as a so-called two-hundred house. Actualization thereof has been desired as building design without depending on a wood house which harms natural environment.

In addition, there are advantages such as repeatable usage after disassembling and metal recycling.

DISCLOSURE OF THE INVENTION

Problems to be Solved by the Invention

Here, for a steel house utilizing metal-made M-shaped channels as structural elements, it is difficult to assemble structural bodies not like a wooden house as performing wood cutting and processing of various joint means and the like. Accordingly, unitization and standardization of structural members of steel houses are unavoidable for steel houses to be in widespread use industrially and economically.

The unitization and standardization of structural members of steel houses bring simplification, homogenization and cost reduction of construction operation of building.

The present invention provides a high-strength unit structural member utilizing superiority in strength of M-shaped channels and a floor structure utilizing the unit structural member.

Further, the present invention provides a unit structural member for building capable of achieving unitization and standardization of structural members of steel houses and simplification, homogenization and cost reduction of construction operation of building and a floor structure utilizing the unit structural member.

Furthermore, the present invention provides a floor structure which utilizes M-shaped channels as structural elements as being capable of ensuring strength while appropriately ensuring space between a floor above and a ceiling below.

Means for Solving the Problems

The M-shaped channel utilized for the present invention is a deformed channel made of metal as typified by steel including a center U-shaped channel section and right and left U-shaped channel sections continuously formed to share right and left side plates of the center U-shaped channel section as a channel trench of the center U-shaped channel section and respective channel trenches of the right and left U-shaped channel sections being opened in mutually opposite directions.

The present invention provides the unit structural member for building including a pair of longitudinal beams formed of long pieces of material of the M-shaped channel as being arranged in parallel at an established distance, and a number of lateral beams formed of short pieces of material of the M-shaped channel as being arranged in parallel laterally between the parallely-arranged longitudinal beams at established distances in the longitudinal direction of the longitudinal beams.

The present invention provides the unit structural member for building further comprising an inclined beam formed of a short piece of material of the M-shaped channel. The inclined beam is arranged approximately on a diagonal line of a frame defined by the longitudinal beams and the lateral beams.

Further, the unit structural member is formed by mutually overlapping bottom plates of the right and left U-shaped channel sections of the M-shaped channels which form the longitudinal beams with those of the M-shaped channels which form the lateral beams and by connecting the longitudinal beams and the lateral beams at the overlapped faces.

The unit structural members are utilized for a floor frame which supports a floor plate or a ceiling plate. The unit structural members are arranged in parallel at established distances on the horizontal plane respectively in a state that the M-shaped channels which form a pair of longitudinal beams are arranged in parallel one above the other. The floor plate is supported by the upper longitudinal beams of the parallely-arranged unit structural members or the ceiling plate is supported by the lower longitudinal beams while the floor plate is supported by the upper longitudinal beams. That is, the floor frame or a floor and ceiling frame is formed by parallely-arranging the unit structural members which are raised in the short-side width direction (i.e., the length direction of the lateral beams).

Effects of the Invention

A unit structural member constituted with a pair of longitudinal beams formed of the parallely-arranged M-shaped channels and a number of lateral beams arranged laterally between the longitudinal beams in parallel at established distances in the longitudinal direction of the longitudinal beams becomes to a robust high-strength structural body which utilizes superiority of the M-shaped channels in strength.

In addition to being effectively utilized for a unit member for a floor frame or a floor frame and ceiling frame of a steel house, the present invention can be utilized as effectively functioning as a building frame unit member for a wall frame and a roof frame.

Entire strength of the unit structural member can be remarkably improved with reinforcement by arranging inclined beams formed of the M-shaped channels approximately on diagonal lines of frames defined by the longitudinal beams and, the lateral beams.

The inclined beams are arranged in all of the plural frames or selected frames defined by the longitudinal beams and the lateral beams.

It is configured to overlap bottom plates of the right and left U-shaped channel sections of the M-shaped channels which form the longitudinal beams with those of the M-shaped channels which form the lateral beam are mutually overlapped and the longitudinal beams and the lateral beams and to connect the longitudinal beams and the lateral beams at the overlapped faces. Accordingly, it is possible to ensure connection strength between the longitudinal beams and the lateral beams, that is, the strength of the unit structural member, while achieving thinning of the unit structural member.

The unit structural member can be effectively utilized as a floor frame which supports a floor plate or a ceiling plate. The unit structural members are set respectively in a state that the M-shaped channels which form a pair of the longitudinal beams are arranged in parallel one above the other. Then, a floor frame or a floor and ceiling frame is formed by arranging the unit structural members in parallel at established distances on the horizontal plane.

Thus, as described above, the unit structural members raised in the short-side width direction, that is, the longitudinal direction of the lateral beams, are arranged in parallel on the horizontal plane to form the floor frame or the floor and ceiling frame. The floor plate is supported by the upper longitudinal beams of the unit structural members which are arranged in parallel or the ceiling plate is supported by the lower longitudinal beams while the floor plate is supported by the upper longitudinal beams. With the above structure, it is possible to sufficiently ensure underfloor space or space between a floor and a ceiling while ensuring strength against vertical load and horizontal load.

In addition, it is possible to achieve unitization and standardization of structural members of building and simplification, homogenization and cost reduction of construction operation of building.

EMBODIMENT FOR CARRYING OUT THE INVENTION

Figures 1A, 1B, 1D:
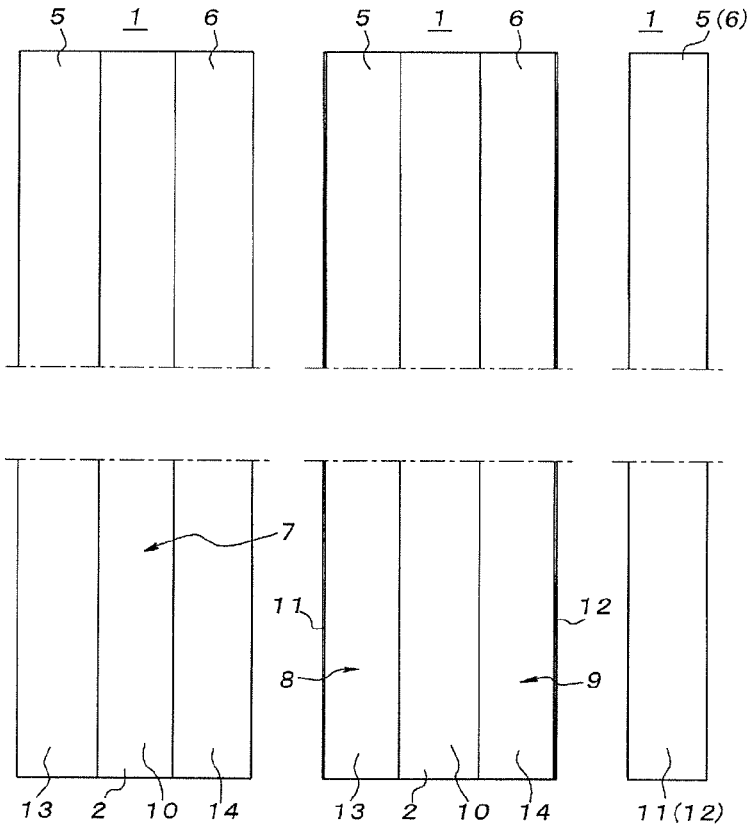
FIG. 1A is a plane view of an M-shaped channel which is utilized for a unit structural member for building according to the present invention.
FIG. 1B is a back view of an M-shaped channel which is utilized for a unit structural member for building according to the present invention.
FIG. 1D is a right and left side view of an M-shaped channel which is utilized for a unit structural member for building according to the present invention.
Figure 1C:
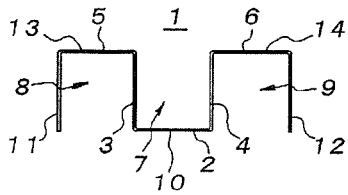
FIG. 1C is a front view of an M-shaped channel which is utilized for a unit structural member for building according to the present invention.

In the following, embodiments of the present invention will be described based on FIGS. 1A~1D to 10.

As illustrated in FIGS. 1A~1D, an M-shaped channel 1 utilized for the present invention is a deformed channel made of metal as typified by steel including a center U-shaped channel section 2 and right and left U-shaped channel sections 6, 5 continuously formed to share right and left side plates 4, 3 of the center U-shaped channel section 2 as a channel trench 7 of the center U-shaped channel section 2 and channel trenches 9, 8 of the right and left U-shaped channel sections 6, 5 are opened in mutually opposite directions.

The center U-shaped channel section 2 includes the right and left side plates 4, 3 and a bottom plate 10 which connects between one end of the right side plate 4 and one end of the left side plate 3. The channel trench 7 is defined by the right and left side plates 4, 3 and the bottom plate 10.

Further, the left U-shaped channel section 5 includes right and left side plates 3, 11 and a bottom plate 13 which connects one end of the right side plate 3 and one end of the left side plate 11. The channel trench 8 is defined by the right and left side plates 3, 11 and the bottom plate 13. The left U-shaped channel section 5 shares the left side plate 3 of the center U-shaped channel section 2 as an inner side plate thereof and inherently includes the outer side plate (i.e., the left side plate) 11 which faces thereto.

Similarly, the right U-shaped channel section 6 includes right and left side plates 12, 4 and a bottom plate 14 which connects one end of the right side plate 12 and one end of the left side plate 4. The channel trench 9 is defined by right and left side plates 12, 4 and the bottom plate 14. The right U-shaped channel section 6 shares the right side plate 4 of the center U-shaped channel section 2 as an inner side plate thereof and inherently includes the outer side plate (i.e., the right side plate) 12 which faces thereto.

As described above, the M-shaped channel 1 has a structure in which the bottom plate 13 of the left U-shaped channel section 5 is connected to an open-side end portion of the one side plate 3 of the center U-shaped channel section 2 and the bottom plate 14 of the right U-shaped channel section 6 is connected to an open-side end portion of the other side plate 4 thereof, the bottom plate 10 of the center U-shaped channel section 2 and the respective bottom plates 14, 13 of the right and left U-shaped channel sections 6, 5 exist at mutually opposite sides, and the channel trench 7 of the center U-shaped channel section 2 and the respective channel trenches 9, 8 of the right and left U-shaped channel sections 6, 5 are opened in mutually opposite directions.

The present invention provides a unit structural member 20 for building utilizing the M-shaped channel 1 made of metal and a floor structure utilizing the unit structural member 20.

For example, short-side width of the side plates 3, 4, 11, 12 and that of the bottom plates 10, 13, 14 are equally formed. In this manner, short-side width of all of the side plates 3, 4, 11, 12 and that of the channel trenches 7, 8, 9 are equally formed so as to obtain a structure in which a side plate of the M-shaped channel 1 oriented horizontally can be fitted to the channel trenches 7, 8, 9 of the M-shaped channel 1 oriented vertically.

The unit structural member 20 is provided with a pair of longitudinal beams 15 formed of long pieces of material of the M-shaped channel 1 as being arranged in parallel at an established distance and is further provided with a number of lateral beams 16 formed of short pieces of material of the M-shaped channel 1 as being arranged in parallel laterally between the longitudinal beams 15 at established distances in the longitudinal direction of the longitudinal beams 15.

The both M-shaped channels 1 which form the pair of longitudinal beams 15 are formed in approximately the same length. Similarly, the M-shaped channels 1 which form a number of the lateral beams 16 are mutually formed in approximately the same length. Further, the both end faces of each lateral beam 16 are terminated at approximately the same plane of bilateral outer side faces of the pair of longitudinal beams 15. Then, the distance between the longitudinal beams 15 is set by connecting the lateral beams 16 to the longitudinal beams 15.

The above is not intended to exclude a case where both ends of the lateral beams 16 are projected having limited length from the bilateral outer side faces of the longitudinal beams 15 and the projected portions are utilized for joint and the like.

The unit structural member 20 has a ladder-like structure in which each of the longitudinal beam 15 and the lateral beam 16 are formed respectively with the M-shaped channel 1 and the both 15, 16 are assembled in a ladder-shape.

Figure 5:
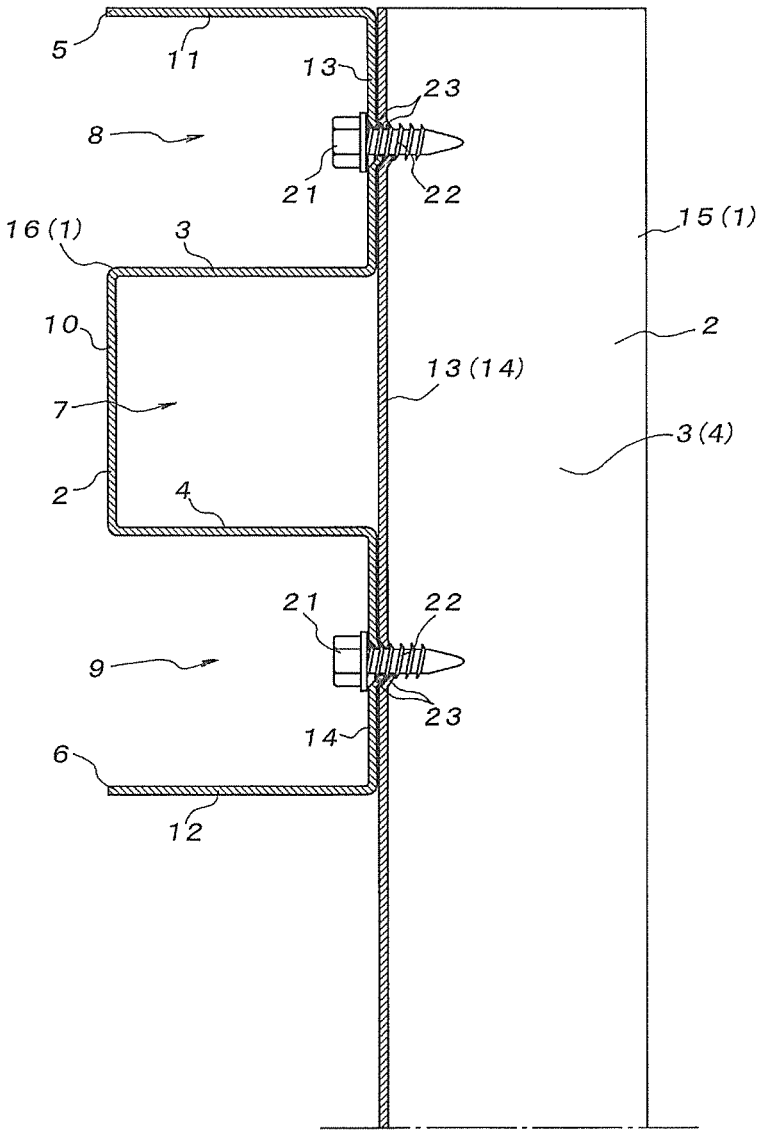
FIG. 5 is a sectional view illustrating an enlarged connection structure (i.e., a screw-fixing structure) between the longitudinal beam and the lateral beam of the unit structural member.

FIG. 5 exemplifies a preferable connection structure between the M-shaped channel 1 which forms the longitudinal beam 15 and the M-shaped channel 1 which forms the lateral beam 16. As illustrated in the drawing, the bottom plates 14, 13 of the right and left U-shaped channel sections 6, 5 of the M-shaped channel 1 which forms the longitudinal beam 15 and the bottom plates 14, 13 of the right and left U-shaped channel sections 6, 5 of the M-shaped channel 1 which forms the lateral beam 16 are mutually overlapped, and then, the longitudinal beam 15 and the lateral beam 16 are connected at the overlapped faces.

Hence, it is configured that the two bottom plates 13, 14 of the longitudinal beam 15 and the two bottom plates 13, 14 of the lateral beam 16 are overlapped as intersecting at approximate the right angle and are connected at respective overlapped faces.

As connection means of the above, it is possible to adopt tacking or screwing as penetrating the respective overlapped faces.

Alternatively, it is possible to perform connection with welding such as spot welding without utilizing a tack or a screw. Alternatively, it is also possible to connect the both with a method in which a projection forcedly headed at one plate is fitted into a recess headed at the other plate.

FIG. 5 illustrates a nut-less connection structure which utilizes a metal-made screw 21 having a male thread 22 at the circumferential face and sharpened top end and in which the screw 21 is forcedly driven to penetrate the overlapped faces so that the male thread 22 is engaged with a burring piece 23 formed by the driving.

To facilitate driving of the screw 21 and forming of the burring piece 23, it is possible to adopt a nut-less connection structure in which a relatively small pilot hole or a cross-shaped split is prepared at a position where the screw 21 is to be driven and burring is performed on a split piece as driving the screw 21 at the center of the split, that is, the male thread 22 of the screw 21 is engaged with a distal end of the burring piece 23 with biting while forming the burring piece 23.

In this manner, strong connection between the longitudinal beam 15 and the lateral beam 16 can be obtained at four overlapped faces respectively with the forcedly driven screw 21, so that entire strength of the unit structural member 20 is ensured.

Accordingly, with the connection structure as overlapping two stripes of the bottom plates 13, 14 of the longitudinal beam 15 and two stripes of the bottom plates 13, 14 of the lateral beams 16, thinning of the unit structural member 20 can be achieved while ensuring the connection strength between the longitudinal beam 15 and the lateral beam 14, that is, the strength of the unit structural member 20.

In addition to being effectively utilized for a floor frame or a floor and ceiling frame of a steal house, the unit structural member 20 can be utilized as effectively functioning as a unit member for a wall frame and a roof frame.

Figure 2A:
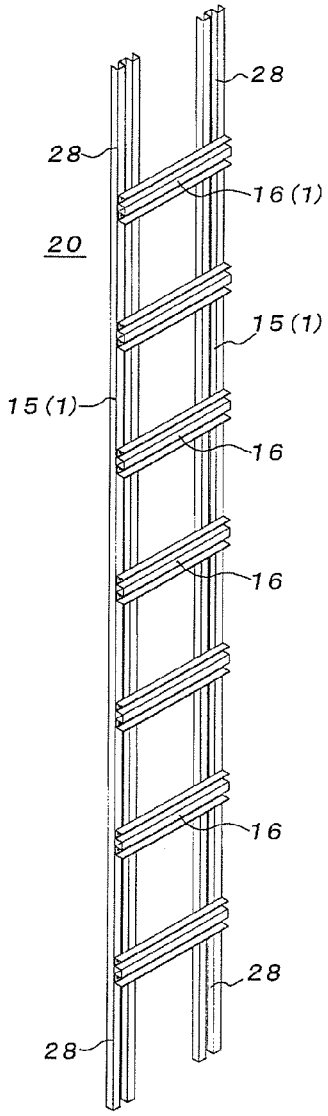
FIG. 2A is a perspective view illustrating an example in which an elongated end portions of longitudinal beams are disposed at end portions of the unit structural member constituted with the M-shaped channels according to the present invention.
Figure 2B:
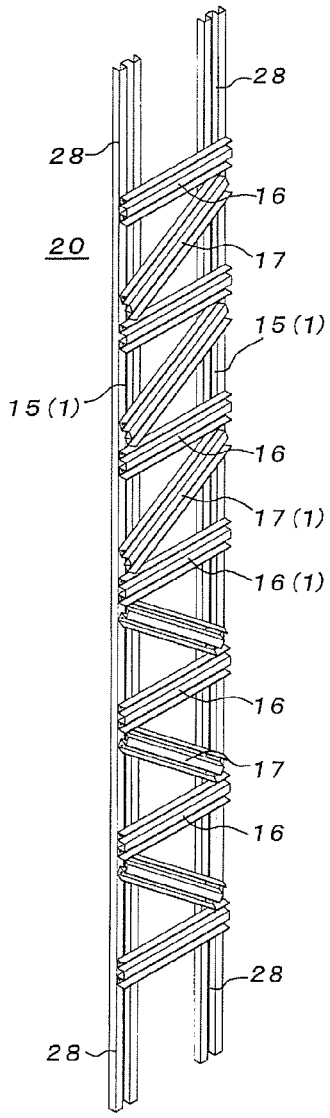
FIG. 2B is a perspective view illustrating an example in which inclined beams are disposed to the unit structural member.
Figure 3A:
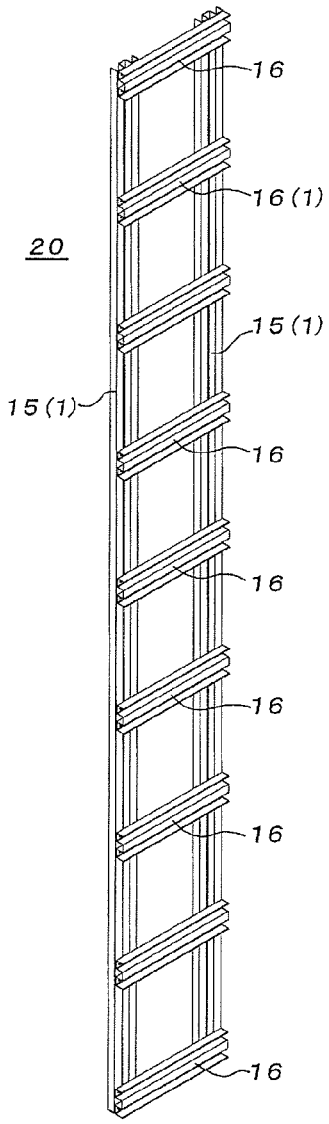
FIG. 3A is a perspective view illustrating an example in which lateral beams are disposed without disposing the elongated end portion of the longitudinal beam at end portions of the unit structural member constituted with the M-shaped channels according to the present invention.
Figure 3B:
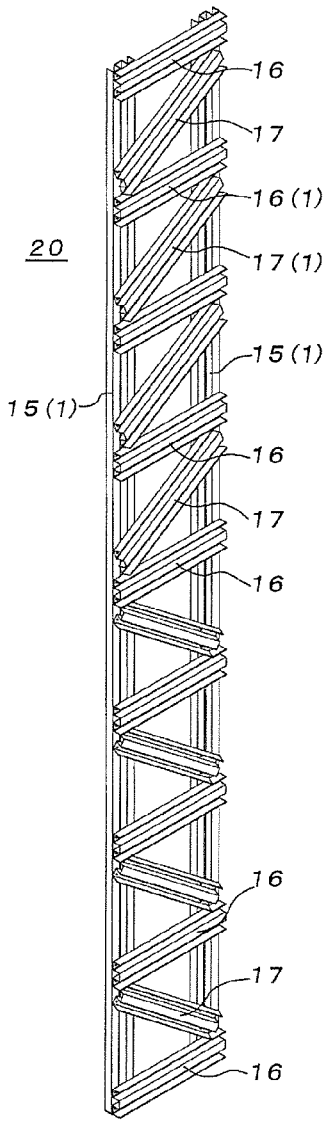
FIG. 3B is a perspective view illustrating an example in which inclined beams are disposed to the unit structural member.
Figure 4A:
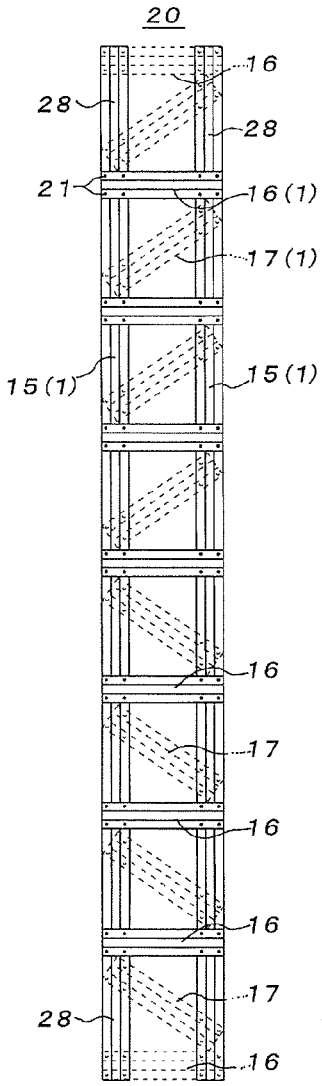
FIG. 4A is a plane view of the unit structural member illustrated in FIGS. 2 and 3.
Figure 4B:
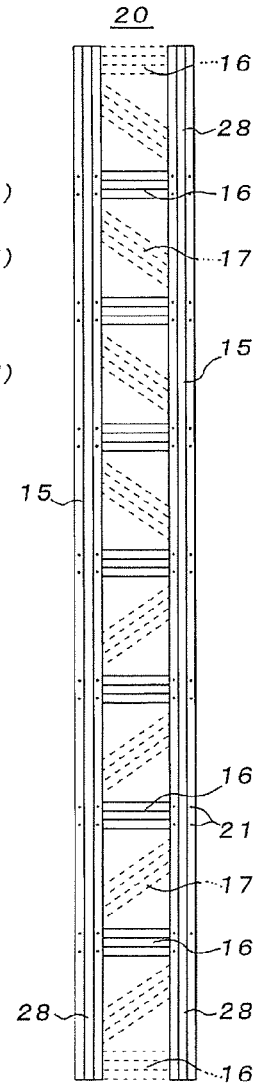
FIG. 4B is a back view of the unit structural member illustrated in FIGS. 2 and 3.
Figure 4C:
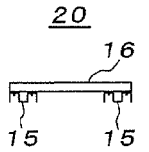
FIG. 4C is a front view of the unit structural member illustrated in FIGS. 2 and 3.
Figure 4D:
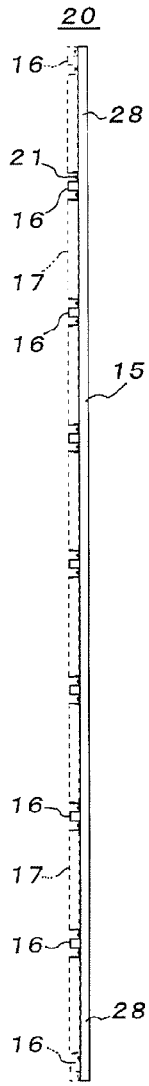
FIG. 4D is a right and left side view of the unit structural member illustrated in FIGS. 2 and 3.

FIGS. 2B and 3B respectively illustrate an embodiment in which inclined beams 17 are arranged to the ladder-shaped unit structural member 20 of FIGS. 2A and 3A. Reinforcement is performed by arranging the inclined beams 17 formed of the M-shaped channels 1 approximately on diagonal lines of frames defined by the longitudinal beams 15 and the lateral beams 16, so that the entire strength of the unit structural member 20 can be improved.

The inclined beams 17 are arranged in all of the plural frames or selected frames defined by the longitudinal beams 15 and the lateral beams 16. Both ends of each inclined beam 17 are connected to the longitudinal beams 15. As a preferable example, the connection is performed by utilizing the connection means with the screws 21 illustrated in FIG. 5.

For arranging the inclined beams 17 in the plural frames defined by the longitudinal beams 15 and the lateral beams 16, it is possible to combine leftward-inclined beams 17 and rightward-inclined beams 17. For example, the leftward-inclined beams 17 (or the rightward-inclined beams 17) are arranged at the left half portion of the unit structural member 20 and the rightward-inclined beams 17 (or the leftward-inclined beams 17) are arranged at the right half portion thereof. Alternatively, it is configured to alternately arrange the leftward-inclined beams 17 and the rightward-inclined beams 17.

Figure 6:
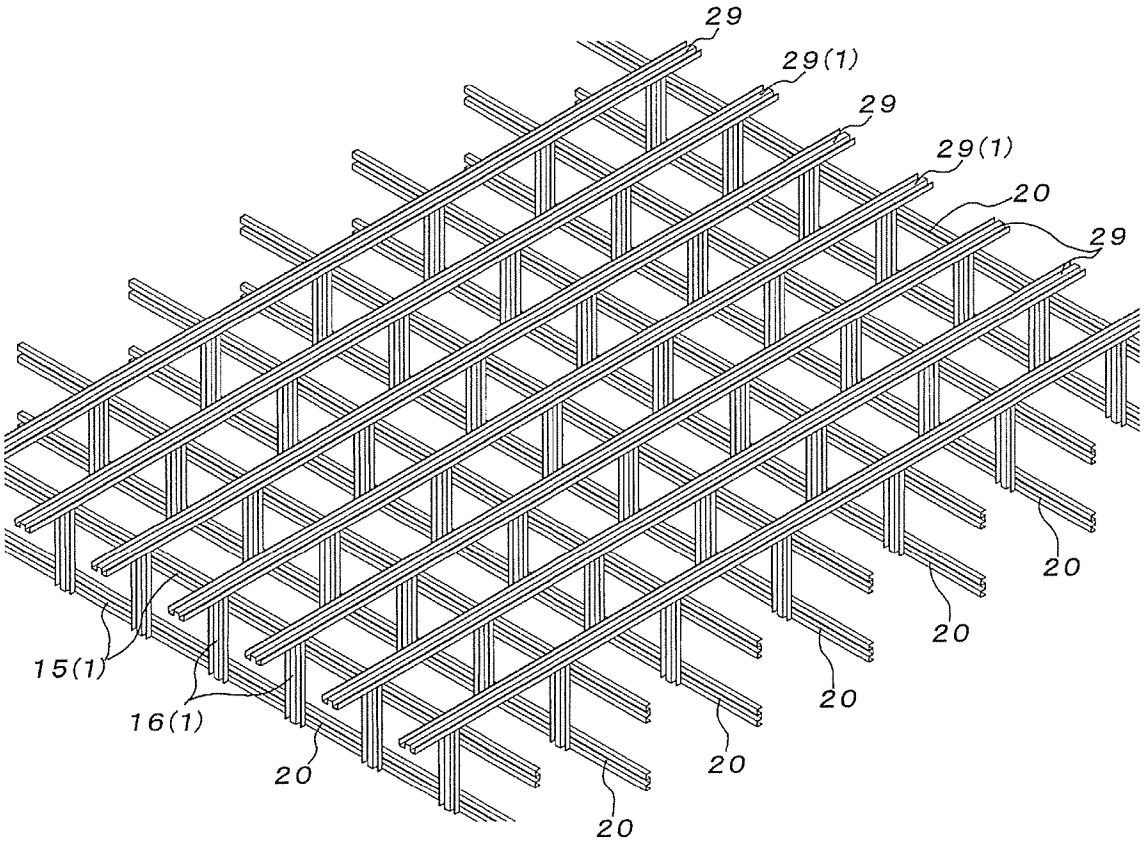
FIG. 6 is a perspective view of a floor frame which is formed by arranging the unit structural members in parallel.
Figure 7:
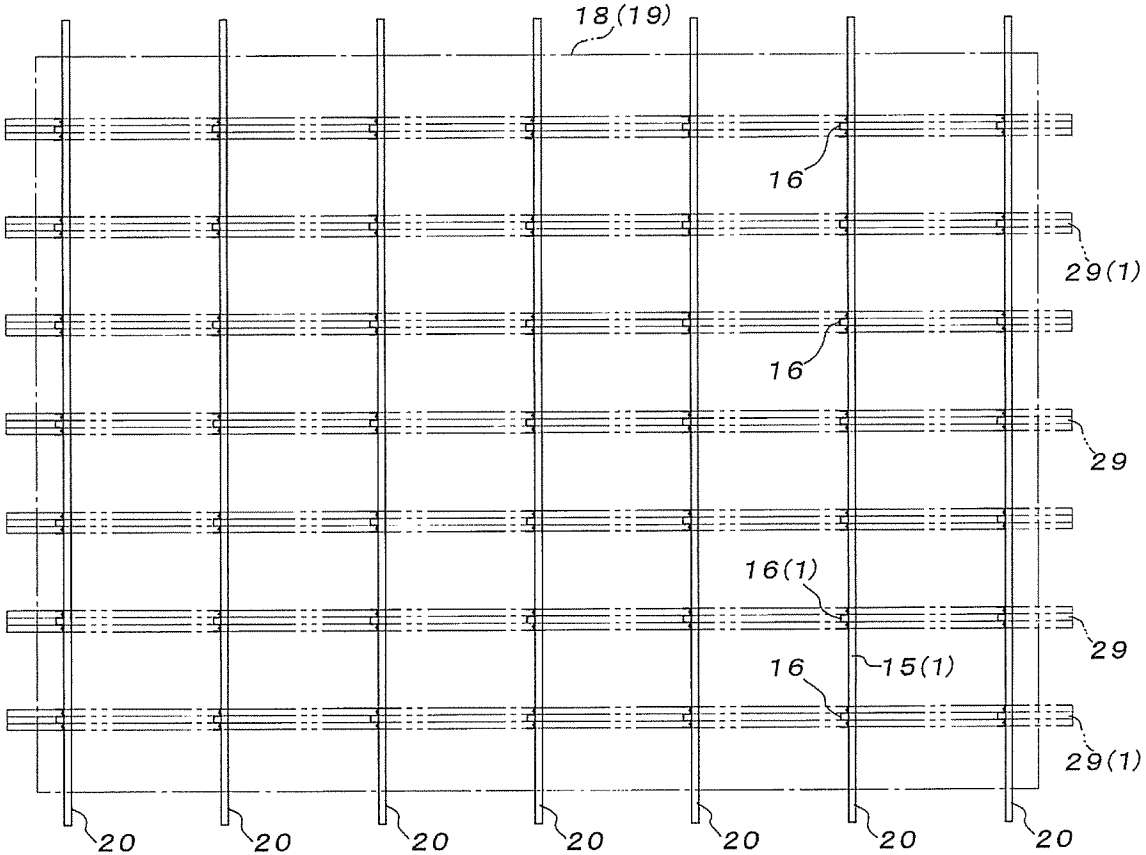
FIG. 7 is a plane view of the floor frame which is formed by arranging the unit structural members in parallel.
Figure 8:
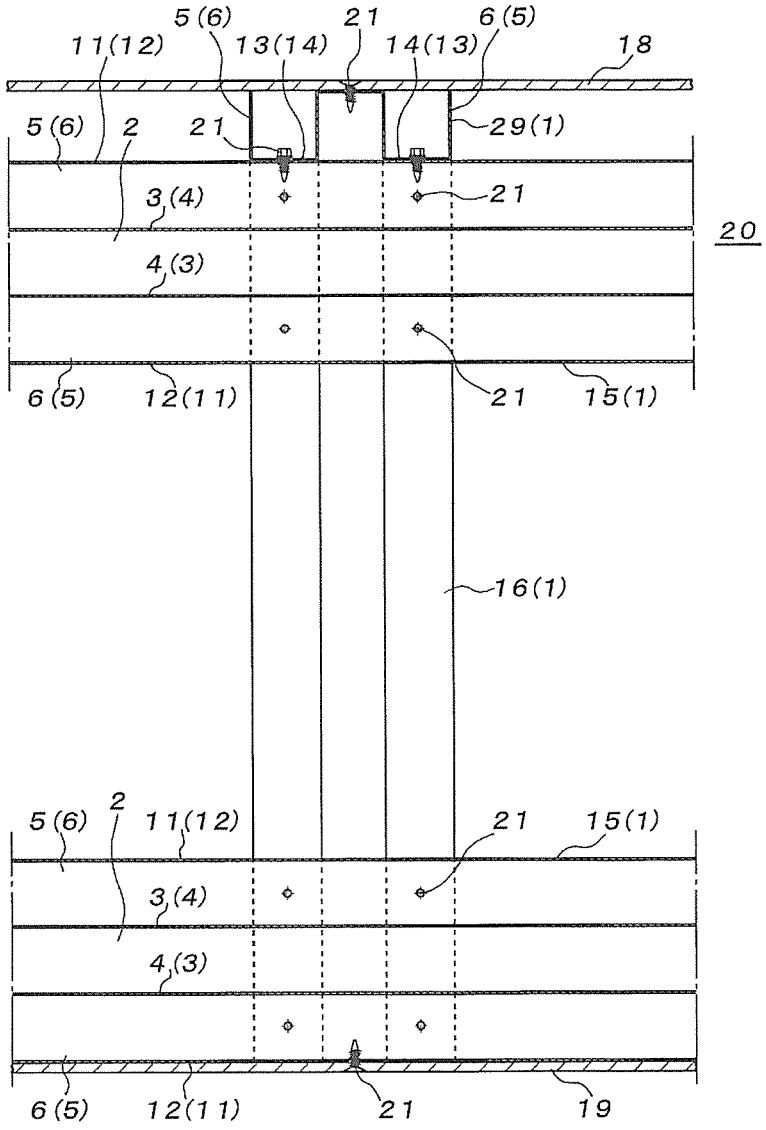
FIG. 8 is a sectional view of a floor structure which is formed by fixing a floor plate to the floor frame with screws.

FIGS. 6 to 8 illustrate a case where the unit structural members 20 are effectively utilized as a floor frame which supports a floor plate 18 or a ceiling plate 19. As illustrated in the drawings, the unit structural members 20 are raised respectively in a state that the M-shaped channels 1 which form a pair of the longitudinal beams 15 are arranged in parallel one above the other. Then, a floor frame or a floor and ceiling frame is formed by arranging the unit structural members 20 in parallel at established distances on the horizontal plane.

Thus, the unit structural members 20 raised in the short-side width direction, that is, the longitudinal direction of the lateral beams 16, are arranged in parallel on the horizontal plane to form the floor frame or the floor and ceiling frame. The floor plate 18 is supported by the upper longitudinal beams 15 of the unit structural members 20 which are arranged in parallel or the ceiling plate 19 is supported by the lower longitudinal beams 15 while the floor plate 18 is supported by the upper longitudinal beams 15.

The floor plate 18 and the ceiling plate 19 are directly connected to the outer side plates 12, 11 of the right and left U-shaped channel sections 6, 5 by utilizing the screws 21 and the like. Alternatively, joists 29 constituted with the M-shaped channels 1, other-shape channels, rods or the like are arranged on the outer side plates 12, 11 of the right and left U-shaped channel sections 6, 5 as extending across all of the unit structural members 20 at intervals in the longitudinal direction of all of the unit structural members 20. Then, the floor plate 18 or the ceiling plate 19 is indirectly connected onto the joists 29 (preferably, onto all of the M-shaped channels 1).

A vertical wall frame 24 for building is formed by assembling the M-shaped channels 1 into a lattice shape. Each of the unit structural members 20 which form the floor frame or the floor and ceiling frame is inserted from a lattice window 25 of one facing wall frame 24 to a lattice window 25 of the other facing wall frame 24, and then, both ends thereof are supported on horizontal frames 26 (i.e., the M-shaped channels 1) which form the wall frames 24 in the laterally raised state.

Then, the unit structural member 20 is moved in the horizontal direction so as to be overlapped to a vertical frame 27 which forms the wall frame 24 and fixing with the screws 21 is performed at the overlapped faces as illustrated in FIG. 5.

Figure 9:
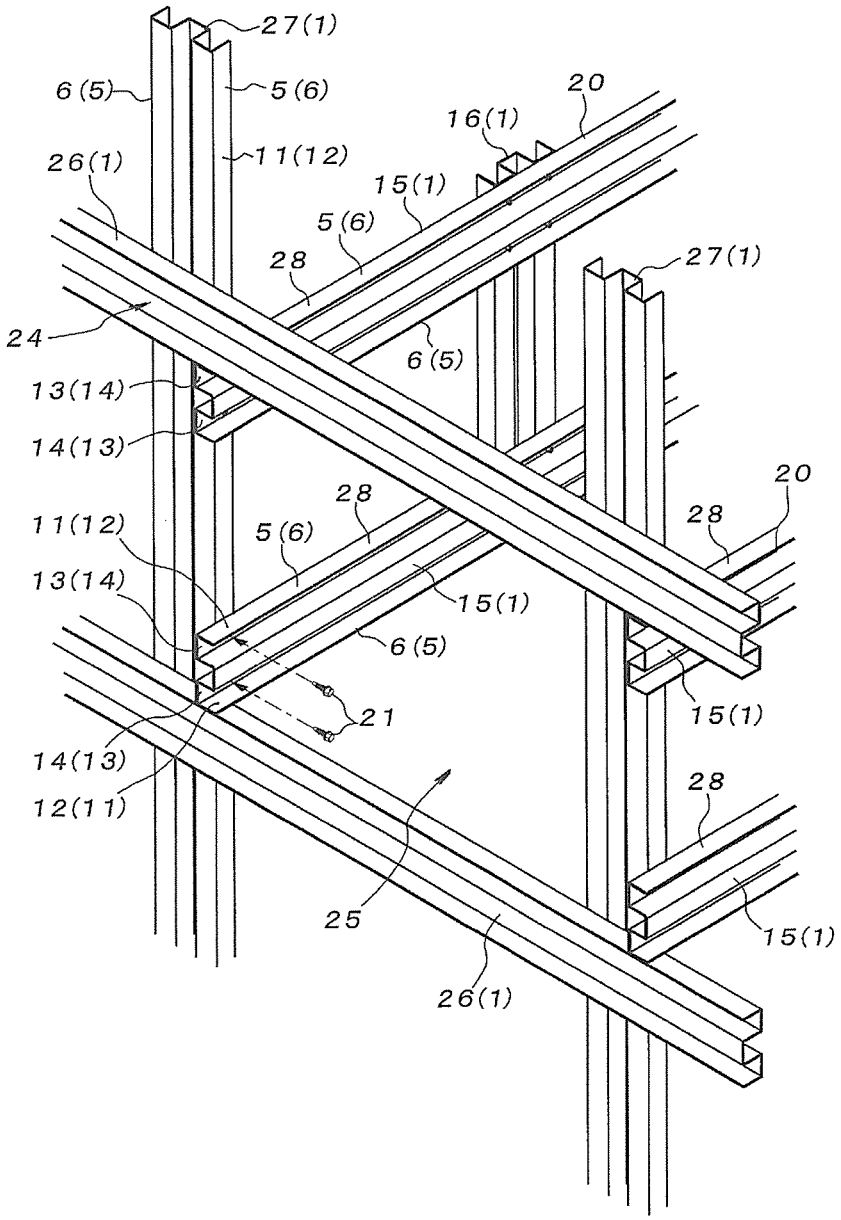
FIG. 9 is a perspective view illustrating an attaching structure between elongated end portions of the unit structural members and vertical frames of a wall frame in a case where a floor frame is structured by utilizing the unit structural members of FIG. 2.

That is, as illustrated in FIG. 9, both ends of the bottom plates 13, 14 of elongated end portions 28 of the right and left U-shaped channel sections 6, 5 which form the unit structural member 20 of FIGS. 2A~2B are overlapped to the side plate 12 or 11 of either of the right and left U-shaped channel sections 6, 5 of the vertical frame 27 which forms the wall frame 24 and fixing is performed by utilizing the screws 21 and the like.

Figure 10:
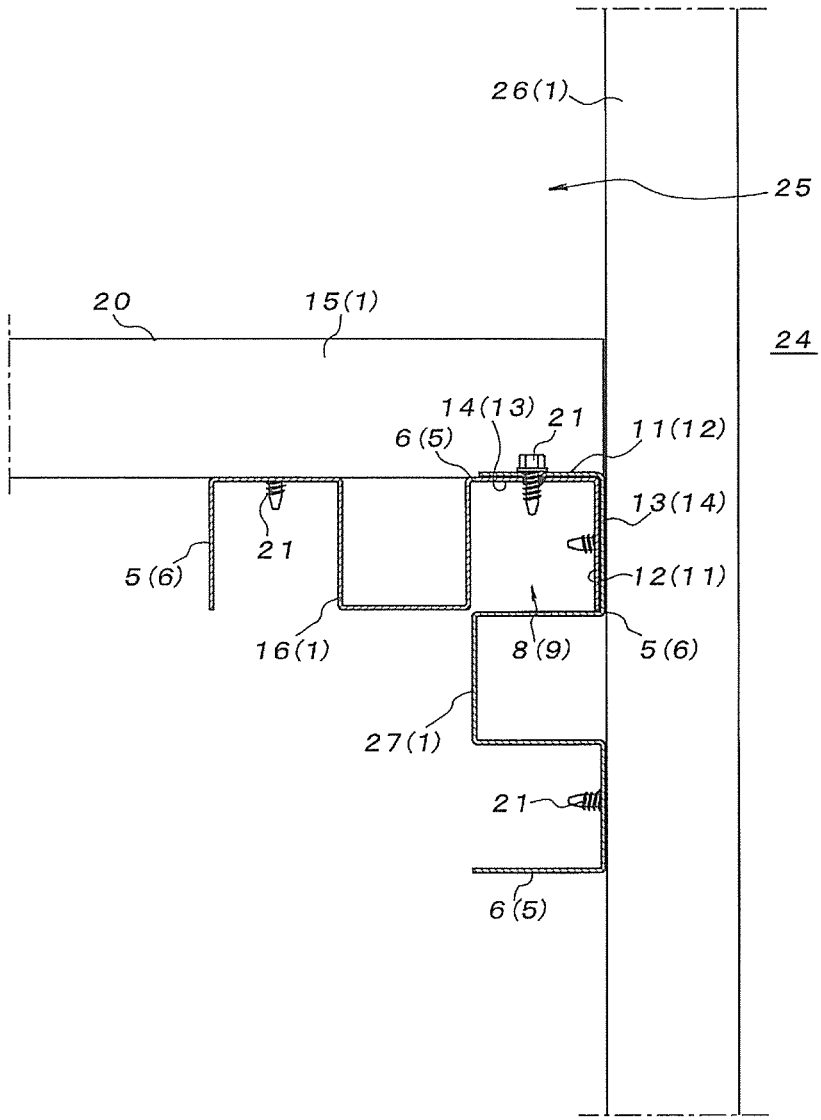
FIG. 10 is a sectional view illustrating an attaching structure between end portion lateral beams of the unit structural member and vertical frames of a wall frame in a case where a floor frame is structured by utilizing the unit structural members of FIG. 3.

Further, as illustrated in FIG. 10, the outer side plate 12 or 11 of either of the right and left U-shaped channel sections 6, 5 which form an end part lateral beam 16 forming the unit structural member 20 of FIGS. 3A~3B is fitted to the channel trench 9 or 8 of either of the right and left U-shaped channel sections 6, 5 of the vertical frame 27 which forms the wall frame 24. Then, the bottom plate 13 or 14 of the unit structural member 20 and the outer side plates 11 or 12 of the vertical frame which are to be overlapped are connected by utilizing the screws 21 and the like.

In both cases of FIGS. 9 and 10, a forming plate of the vertical frame 27 (i.e., the M-shaped channel 1) which forms the wall frame 24 and a forming plate of the unit structural member 20 constituting the floor frame are fixed with the screws 21 as being mutually overlapped.

The floor frame structure utilizing the unit structural members 20 can ensure strength against vertical load and horizontal load while sufficiently ensuring underfloor space or space between a floor and a ceiling.

In addition to being capable of being utilized for a unit member for the floor frame or the floor and ceiling frame, the unit structural member 20 can be used as a unit member which constitutes the wall frame 24 or a roof frame. For example, the unit structural member 20 can be utilized as a gate-shaped frame to reinforce an opening portion of the wall frame 24 or as the unit structural member 20 to reinforce a corner portion of the wall frame 24.

As described above, in a case where the unit structural member 20 is utilized as a unit member which constitutes the wall frame 24, the unit structural member 20 constitutes the wall frame 24 as being vertically raised in the longitudinal direction of the longitudinal beams 15.

As illustrated in FIGS. 2A~B and FIGS. 4A~4D, it is possible to obtain a structure of being connected to the wall frame 24 with the elongated end portion 28 while one end portion or both end portions of the longitudinal beam 15 in the longitudinal direction are provided respectively with the elongated end portion 28 to which the lateral beam 16 is not laterally arranged.

Further, the elongated end portions 28 can be utilized as floor beam forming members of an overhung portion such as a porch and second floor as being projected from the wall frame 24 or as joint members thereof.

Further, as illustrated in FIGS. 3A~3B and FIGS. 4A~4D, an end part lateral beam among the lateral beams 16 is laterally arranged to be matched with an end face of the longitudinal beams 15.

Next, an example to actually structure a floor of building utilizing the unit structural members 20 will be described. First, as described above (see FIG. 6), the unit structural members 20 are raised respectively in a state that the M-shaped channels 1 which form a pair of the longitudinal beams 15 are arranged in parallel one above the other. Then, the floor frame is formed by arranging the raised unit structural members 20 in parallel at established distances on the horizontal plane. Subsequently, the plural joists 29 constituted with the M-shaped channels 1 are supported at intervals on the upper longitudinal beams 15 of the parallely-arranged unit structural members 20.

Figure 11:
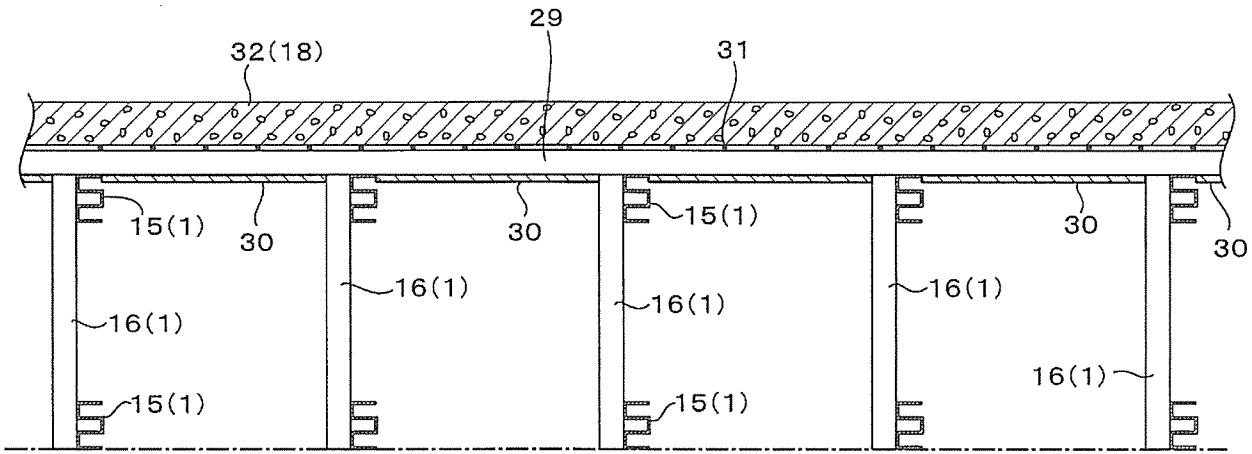
FIG. 11 is a sectional view illustrating a state that a floor of building is structured by utilizing the unit structural members of FIG. 2.

Next, as illustrated in FIG. 11, a formwork 30 formed of plywood and the like is fastened to each space between the upper longitudinal beams 15 of adjacent unit structural members 20, and then, a reinforcing bar 31 formed of a net and the like is laid at the upper face side of the respective joists 29 and mortar 32 is solidified as being casted thereon. Subsequently, the formworks 30 are removed and a floor slab 18 is formed. In this manner, a strong floor of building can be structured.

Figure 12A:
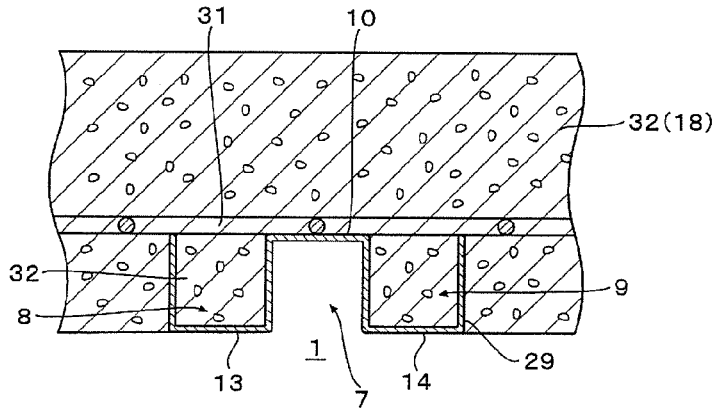
FIG. 12A is a sectional view illustrating a state that mortar is filled in right and left channel trenches of the M-shaped channel.
Figure 12B:
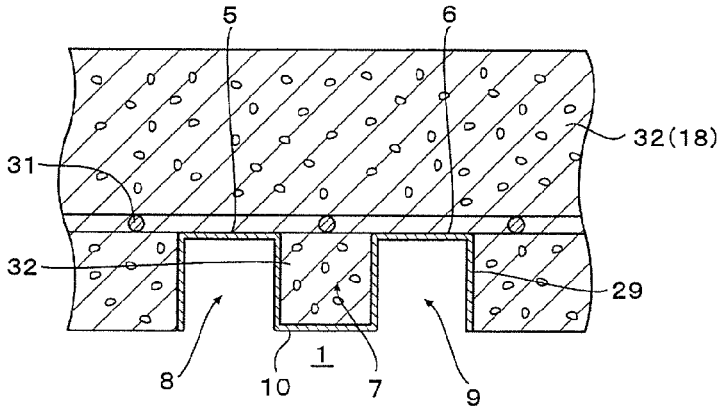
FIG. 12B is a sectional view illustrating a state that mortar is filled into a center channel trench of the M-shaped channel.

Furthermore, in this case, depending on a supported posture of the joists 29 against the longitudinal beams 15, the mortar 32 is filled into the right and left channel trenches 9, 8 of the M-shaped channels 1 which form the joists 29 as illustrated in FIG. 12A or the mortar 32 is filled into the center channel trench 7 as illustrated in FIG. 12B. Accordingly, strength of a floor itself of building can be remarkably improved in either case.

What is claimed is:

1. A unit structural member supporting a floor plate by utilizing an M-shaped channel which is constituted with a center U-shaped channel section and right and left U-shaped channel sections continuously formed to share right and left side plates of the center U-shaped channel section as a channel trench of the center U-shaped channel section and respective channel trenches of the right and left U-shaped channel sections being opened in opposite directions, comprising:

a pair of longitudinal beams formed of long pieces of material of the M-shaped channel as being arranged in parallel at an established distance; and a number of lateral beams formed of short pieces of material of the M-shaped channel as being arranged in parallel laterally between the parallely-arranged longitudinal beams at established distances in the longitudinal direction of the longitudinal beams, wherein bottom plates of the right and left U-shaped channel sections of the M-shaped channels which form the pair of longitudinal beams and bottom plates of the right and left U-shaped channel sections of the M-shaped channels which form the lateral beams are overlapped and the longitudinal beams and the lateral beams are connected at the overlapped faces, the unit structural member is arranged in a state that the M-shaped channels which form respective longitudinal beams are arranged in parallel one above the other, and the floor plate is supported by an upper longitudinal beam of the unit structural member.

2. The unit structural member according to claim 1, wherein an inclined beam formed of a short piece of material of the M-shaped channel is arranged approximately on a diagonal line of a frame defined by the longitudinal beams and the lateral beams.

3. A floor structure, wherein the unit structural members according to claim 2 are arranged in parallel at established distances on the horizontal plane in a state that M-shaped channels which form respective longitudinal beams are arranged in parallel one above the other, and the floor plate is supported by upper longitudinal beams of the parallely-arranged unit structural members.

4. The unit structural member according to claim 2, wherein bottom plates of the right and left U-shaped channel sections of the M-shaped channels which form the pair of longitudinal beams and bottom plates of the right and left U-shaped channel sections of the M-shaped channels which form the lateral beams are overlapped and the longitudinal beams and the lateral beams are connected at the overlapped faces.

5. A floor structure, wherein the unit structural members according to claim 1 are arranged in parallel at established distances on the horizontal plane in a state that M-shaped channels which form respective longitudinal beams are arranged in parallel one above the other, and the floor plate is supported by upper longitudinal beams of the parallely-arranged unit structural members.

* * * * *